United States Patent [19]

Spina

[11] Patent Number: 5,072,151

[45] Date of Patent: Dec. 10, 1991

[54] COLOR PICTURE TUBE HAVING IMPROVED SHADOW MASK FRAME

[75] Inventor: Paolo Spina, Ferentino, Italy

[73] Assignee: Videocolor S.p.A., Anagni, Italy

[21] Appl. No.: 640,722

[22] Filed: Jan. 14, 1991

[51] Int. Cl.[5] ..... H01J 29/07; H01J 29/81

[52] U.S. Cl. ..... 313/407; 313/402

[58] Field of Search ..... 313/402, 407; 29/472.1

[56] References Cited

U.S. PATENT DOCUMENTS

| | | | |
|---|---|---|---|
| 3,516,147 | 6/1970 | Seedorff et al. | 29/472.1 |
| 4,827,180 | 5/1989 | Sone et al. | 313/407 |
| 4,931,690 | 6/1990 | Kokubu et al. | 313/402 |

FOREIGN PATENT DOCUMENTS

| | | | |
|---|---|---|---|
| 988141 | 4/1976 | Canada | 313/407 |

*Primary Examiner*—Donald J. Yusko
*Assistant Examiner*—Diab Hamadi
*Attorney, Agent, or Firm*—Joseph S. Tripoli; Dennis H. Irlbeck

[57] ABSTRACT

An improved color picture tube includes an evacuated envelope having a rectangular faceplate panel. The panel includes a viewing screen on an inner surface thereof and a shadow maskframe assembly mounted therein by support means located at the four corners of the panel. The shadow mask-frame assembly includes an apertured shadow mask and a peripheral frame to which the mask is attached. The frame has two flanges arranged in an L-shaped cross-section. The support means are attached to the corners of the frame. The improvement comprises the frame being formed by four sections that are welded together at their ends. Each section includes a side of the frame and two angled corners of the frame at each end of each section. The sections overlap each other at their ends, with both of the flanges of each section in surface-to-surface contact with each other. With this construction, the frame has a single thickness along each of its sides and a double thickness at its corners, to provide more rigid attachment locations for the support means.

2 Claims, 3 Drawing Sheets

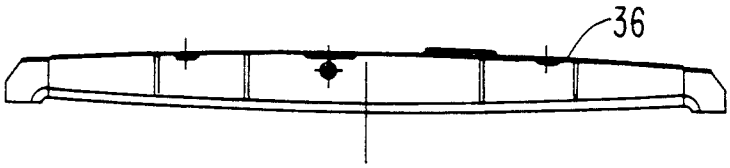
FIG. 3
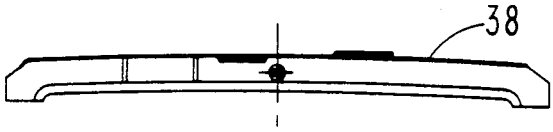
FIG. 4
FIG. 5
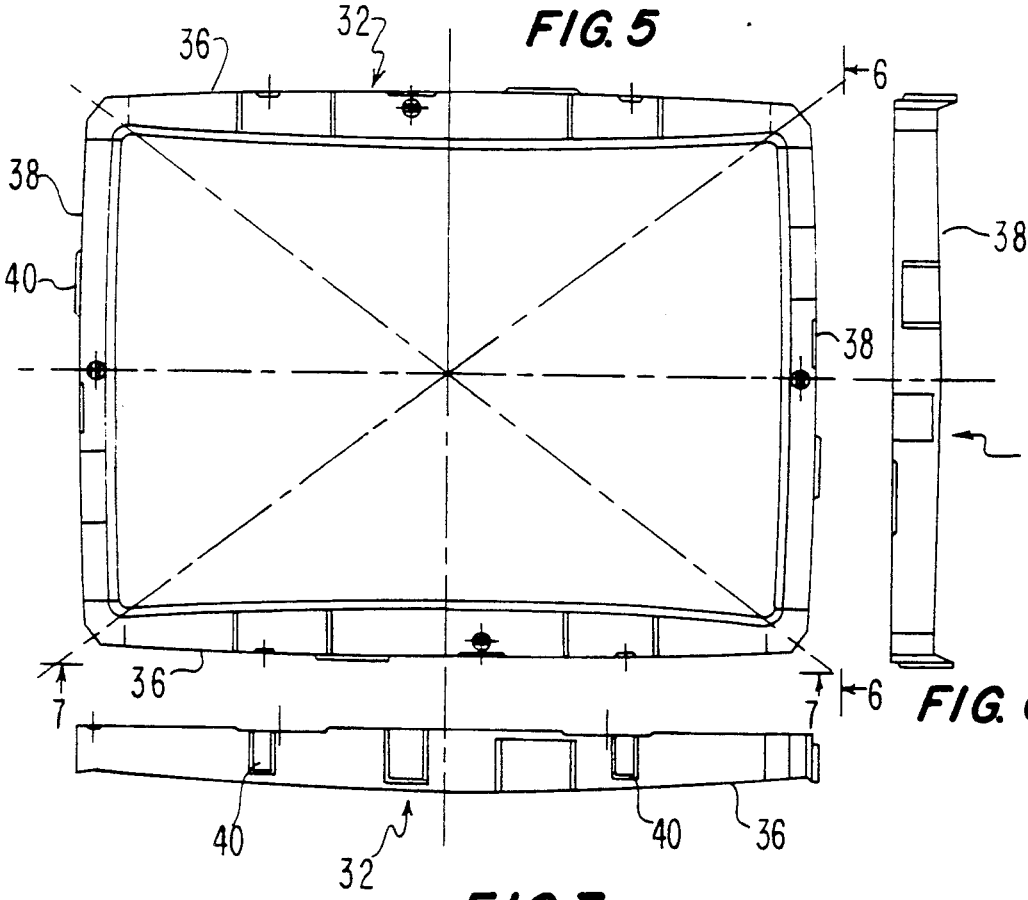
FIG. 6
FIG. 7

COLOR PICTURE TUBE HAVING IMPROVED SHADOW MASK FRAME

This invention relates to a color picture tube of the type having a shadow mask attached to a peripheral frame which is suspended in relation to a viewing screen of the tube, and particularly to such a tube having an improved shadow mask frame with reduced weight.

BACKGROUND OF THE INVENTION

As the sizes of color picture tubes have increased, there has been a corresponding increase in the sizes and weights of tube components. One of these components is the shadow mask frame. Present color picture tubes use steel frames to support the shadow masks within the faceplate panels of the tubes. One type of frame is made from a continuous piece of L-shaped steel, that is bent and welded to itself at its ends. Another type of frame is formed by pressing a flat steel sheet into the shape of the frame. A third type of frame is disclosed in Canadian Patent 988,141, issued to T. M. Shrader and K. A. Long on Apr. 27, 1976. This patent shows a frame that is formed from four pieces that are welded together at the four corners of the frame. The cited purpose of using four pieces is to provide an adjustable frame to precisely fit within a particular mask. Each of the four pieces has two flanges configured in an L-shaped cross-section. A first of the flanges extends toward a screen of the tube and a second flange extends from the first flange toward a central longitudinal axis of the tube. In each piece, the first flange extends beyond the second flange at both ends of the piece. These extensions of the first flange overlap each other in the corners of the frame and are where the pieces are welded together.

The three frame types discussed above are usually supported within a faceplate panel by either three or four springs that are attached to the sides of the frames. Recently, large tubes have been suggested that are supported within faceplates by four springs located at the corners of the mask frame. The present invention provides a frame with reduced weight that can be used in a tube having corner support springs.

SUMMARY OF THE INVENTION

An improved color picture tube includes an evacuated envelope having a rectangular faceplate panel. The panel includes a viewing screen on an inner surface thereof and a shadow mask assembly mounted therein by support means located at the four corners of the panel. The shadow mask assembly includes an apertured shadow mask and a peripheral frame to which the mask is attached. The frame has two flanges arranged in an L-shaped cross-section. The support means are attached to the corners of the frame. The improvement comprises the frame being formed by four sections that are welded together at their ends. Each section includes a side of the frame and two angled corners of the frame at the ends of the section. The sections overlap each other at their ends, with both of the flanges of each section in surface-to-surface contact with each other. With this construction, the frame has a single thickeness along each of its sides and a double thickness at its corners, to provide more rigid attachment locations for the support means.

BRIEF DESCRIPTION OF THE DRAWINGS

FIGS. 3 and 4 are plan views of a long section and a short section, respectively, of a shadow mask frame.

FIG. 5 is a plan view of a complete shadow mask frame.

FIGS. 6 and 7 are side views of the frame taken at lines 6—6 and 7—7 of FIG. 5, respectively.

DETAILED DESCRIPTION OF THE PREFERRED EMBODIMENTS

Figure 1:
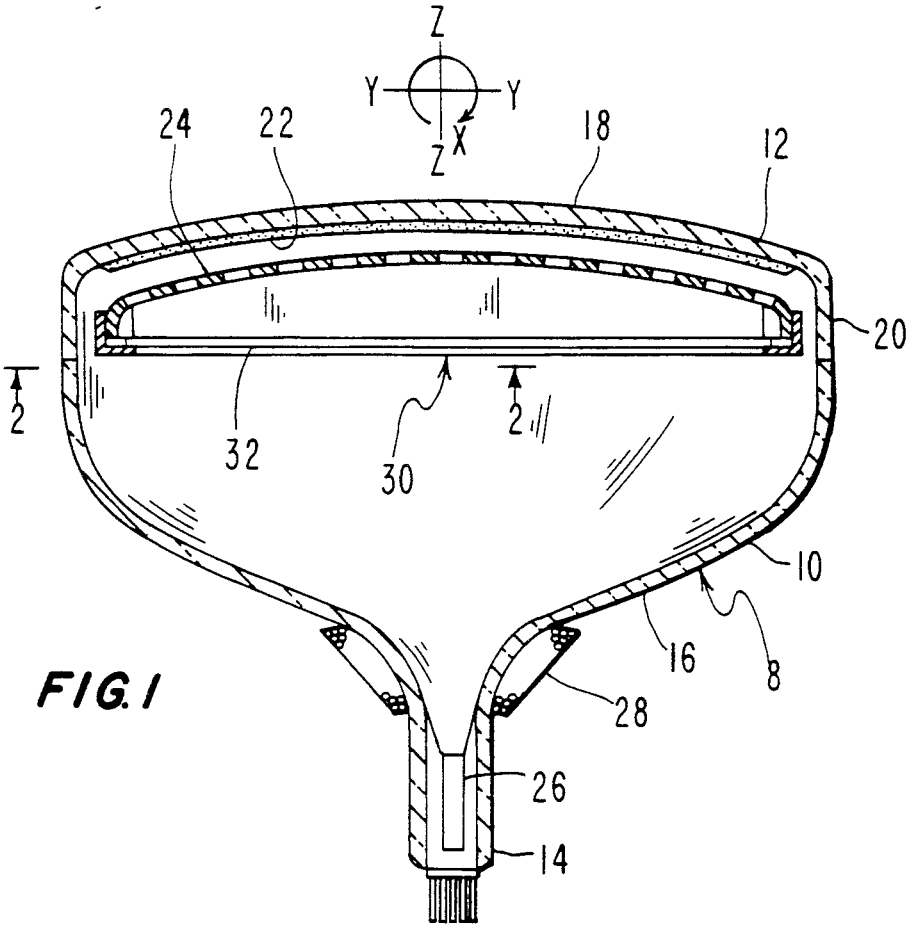
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orhtogonal axes: a major axis X, parallel to its wider dimension (usually horizontal), and a minor axis Y, parallel to its narrower dimension (usually vertical). The major and minor axes are perpendicular to a central longitudinal axis Z of the tube, which passes through both the center of the neck 14 and the center of the panel 12. A mosaic three-color phosphor screen 22 is located on the inner surface of the faceplate 18. The screen preferably is a line screen, with the phosphor lines extending substantially parallel to the minor axis Y. Alternatively, the screen may be a dot screen. A multiapertured color selection or shadow mask 24 is removably mounted in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke 28 located in the vicinity of the funnel-to-neck junction. When activated, the yoke 28 subjects the three electron beams to magnetic fields which cause the beams to scan horizontally and vertically in a rectangular raster over the screen 22.

Figure 2:
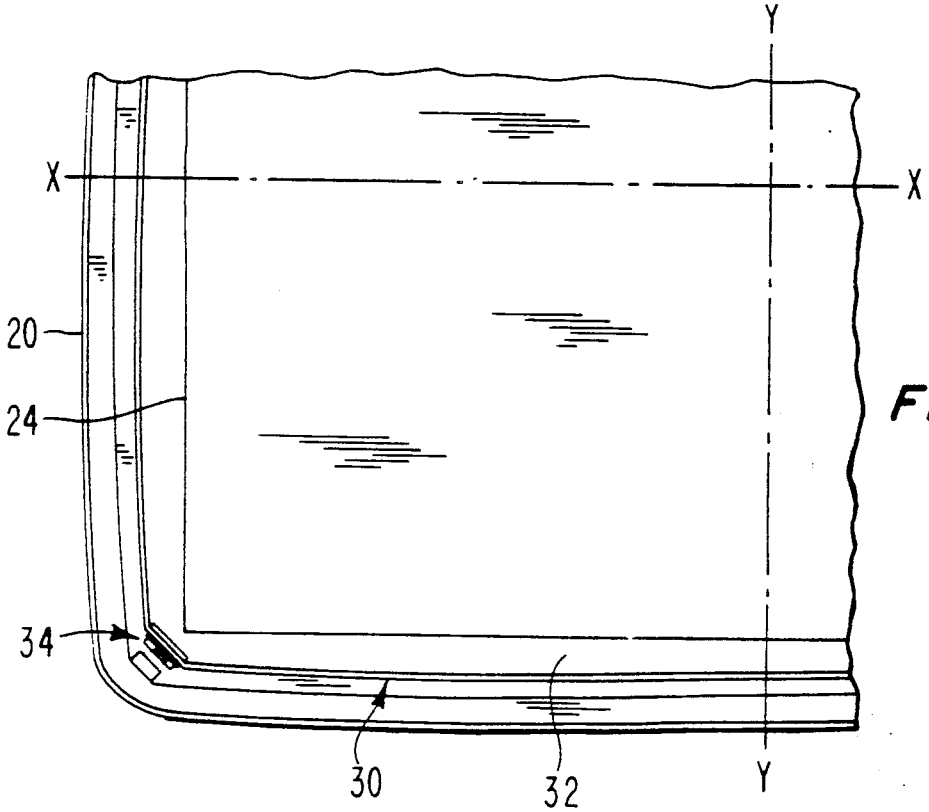
FIG. 2 is a plan view of a quadrant of the tube faceplate, taken at line 2—2 of FIG. 1.

The shadow mask 24 is part of a mask-frame assembly 30 that also includes a novel peripheral frame 32. The mask-frame assembly 30 is shown positioned within the faceplate panel 12 in FIG. 1. As shown in FIG. 2, the mask-frame assembly 30 is mounted to the panel 12 by four support means 34 positioned at the four corners of the assembly.

The novel mask frame 32 is formed from four sections; two identical long sections 36, one of which is shown in FIG. 3, and two identical short sections 38, one of which is shown in FIG. 4. Each section includes a side of the frame and two angled corners of the frame at each end of each section. When assembled, the sections overlap each other at their end and are welded together, thus forming the completed frame shown in FIGS. 5, 6 and 7. The overlapping of the section ends provides an area of double thickness at each corner, which adds to the rigidity of the frame in the locations of the support means. For example, in a frame having a thickness of 0.7 mm, the corners will be 1.4 mm thick.

To assure that the frame has enough stiffness, embossmen 40 are located at various positions on all four sections of the frame.

Figure 8:
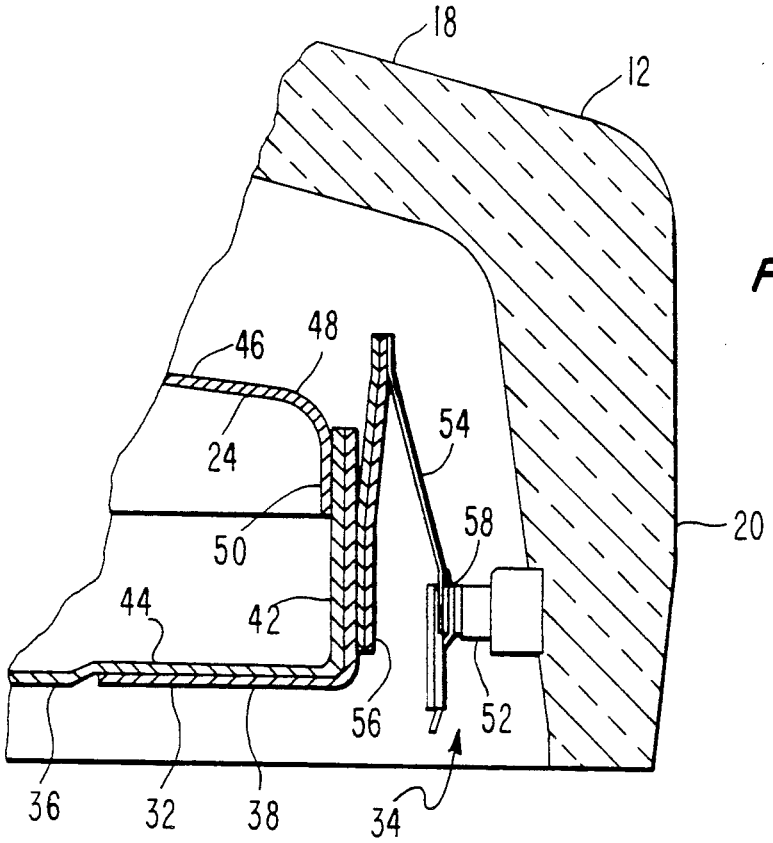
FIG. 8 is an enlarged cross-sectional view of a corner of the faceplate panel of the tube of FIG. 1.
Figure 9:
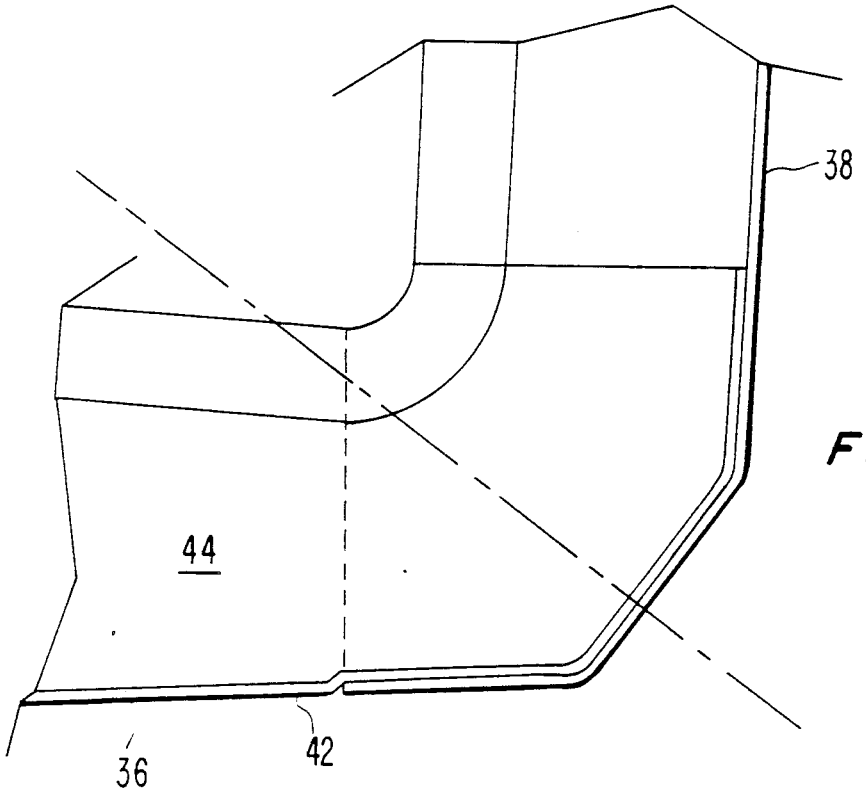
FIG. 9 is an enlarged plan view of a corner of the frame of the tube of FIG. 1.

The frame 32, as shown in FIGS. 8 and 9, includes two substantially perpendicular flanges, a first flange 42 and a second flange 44, in an L-shaped cross-sectional configuration. The first flange 42 extends from the intersection of the flanges in a direction toward the screen 22. The second flange 44 extends inwardly from the intersection of the flanges in a direction toward the central longitudinal axis Z of the tube 8. The four corners of the frame 32 are truncated, being angled approximately perpendicularly to the diagonal directions of the frame.

The shadow mask 24 includes a curved apertured portion 46, an imperforate border portion 48 surrounding the apertured portion 46, and a skirt portion 50 bent back from the border portion 48 and extending away from the screen 22. The mask 24 is telescoped within or set inside the frame 32, and the skirt portion 50 is welded to the inside surface of the first flange 42.

The mask-frame assembly support means 34, shown in detail in FIG. 8, are included at each of the four corners of the frame and panel. Each support means 34 includes a stud 52, a spring 54 and a plate 56. Each stud 52 is a conically-shaped metal member that is attached to the panel sidewall 20. Each plate 56 is welded near one of its ends to the flange 42 at a truncated corner of the frame 32. The spring 54 is attached at one of irs ends to the other end of the plate 56. An aperture 58, near the free end of each spring 54, engages the conical portion of the stud 52.

Although the frame 32 is shown as be of a planar type, the present invention can be applied to any frame geometry, such as barrel or bowed. A frame constructed in accordance with the present invention uses a minimum amount of material and is lighter than a one piece frame of similar strength. This results in a cost reduction, better thermal performance and reduced warpage during long-term operation. The thinner material is easier to machine, and the completed frame is stable for mechanical shocks and vibrations.

What is claimed is:

1. In a color picture tube including an evacuated envelop having a rectangular faceplate panel, said panel including a viewing screen on an inner surface thereof and a shadow mask-frame assembly mounted therein by support means located at the four corners of said panel, said shadow mask-frame assembly including an apertured shadow mask and a peripheral frame to which said mask is attached, and said support means being attached to the corners of said frame, the improvement comprising said frame being formed by four sections that are welded together at their ends, each section of said frame including a side, a first and a second flange and two angled corners each end, and said sections overlapping each other at their ends with both first and second flanges of each section in surface-to-surface contact with each other, whereby said frame has a single thickness along each of its sides and a double thickness at its corners, to provide more rigid attachment locations for said support means.

2. In a color picture tube including an evacuated glass envelope having a rectangular faceplate panel with two long sides and two short sides, said panel including a major axis paralleling said long sides, a minor axis paralleling said short sides, two diagonals extending between opposing conrners of said panel and a central longitudinal axis passing perpendicularly through the intersection of said major and minor axes and said diagonals, said panel including a viewing screen on an inner surface thereof and a shadow mask-frame assembly mounted therein by support means located at the four corners of said panel, said shadow mask-frame assembly including an apertured shadow mask and a peripheral frame to which said mask is attached, said frame including two opposing long sides that substantially parallel said major axis, two opposing short sides that substantially parallel said minor axis and corner portions that are acutely angled to both the long and short sides and are approximately perpendicular to the panel diagonals, said frame having two flanges in an L-shaped cross-section, a first of said flanges extending toward said screen substantially paralleling said central longitudinal axis and a second flange extending inwardly from an intersection of said flanges toward said central longitudinal axis, and said support means being attached to said first flange at the corners of said frame, the improvement comprising said frame being formed by four sections that are welded together at their ends, each section including a side of the frame and two angled corners of the frame at each end of each section, and said sections overlapping each other at their ends with both first and second flanges of each section in surface-to-surface contact with each other, whereby said frame has a single thickness along each of its sides and a double thickness at its corners, to provide more rigid attachment locations for said support means.

* * * * *

UNITED STATES PATENT AND TRADEMARK OFFICE

CERTIFICATE OF CORRECTION

PATENT NO. : 5,072,151

DATED : December 10, 1991

INVENTOR(S) : Paolo Spina

It is certified that error appears in the above-identified patent and that said Letters Patent is hereby corrected as shown below:

Column 4, line 6, before "each" insert --at-- and

Column 4, line 19, change "conrners" to --corners--

Signed and Sealed this

Sixteenth Day of November, 1993

*Attest:*

*Attesting Officer*

BRUCE LEHMAN

*Commissioner of Patents and Trademarks*